US007874898B2

(12) United States Patent
Exposito

(10) Patent No.: US 7,874,898 B2
(45) Date of Patent: Jan. 25, 2011

(54) COVER FOR OUTDOOR ROOF OPENING

(75) Inventor: Agustin Exposito, Davie, FL (US)

(73) Assignee: Action Metal Fabrications Corp., Hialeah, FL (US)

( * ) Notice: Subject to any disclaimer, the term of this patent is extended or adjusted under 35 U.S.C. 154(b) by 114 days.

(21) Appl. No.: 11/803,657

(22) Filed: May 15, 2007

(65) Prior Publication Data

US 2008/0287055 A1 Nov. 20, 2008

(51) Int. Cl.
*F23L 17/02* (2006.01)

(52) U.S. Cl. ..... 454/37; 454/35; 454/34; 454/32

(58) Field of Classification Search ..... 454/32, 454/34, 37

See application file for complete search history.

(56) References Cited

U.S. PATENT DOCUMENTS 441,101 A * 11/1890 Kayser ..... 454/37
514,252 A * 2/1894 Blankley ..... 454/35
5,025,712 A * 6/1991 Perry ..... 454/35
5,816,288 A * 10/1998 Zelch ..... 137/587
6,805,627 B2 * 10/2004 Marts et al. ..... 454/368
2003/0110554 A1 * 6/2003 Hernandez ..... 4/218

* cited by examiner

*Primary Examiner*—Steven B McAllister
*Assistant Examiner*—Samantha A Miller
(74) *Attorney, Agent, or Firm*—Mark Terry

(57) ABSTRACT

An apparatus for covering an exterior opening in a roof is disclosed. The apparatus includes a hollow conical element defining an inner volume, the conical element having a first opening on a wide end and a second opening on a narrow end. The apparatus further includes a planar element surrounding an outer brim of the first opening, wherein the planar element accepts a fastener for fastening the apparatus to the roof. The apparatus further includes at least one louver covering the second opening and at least one screen located within the inner volume of the conical element, wherein the at least one screen is fastened to an inner surface of the conical element.

18 Claims, 6 Drawing Sheets

COVER FOR OUTDOOR ROOF OPENING

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of commercial construction, and more particularly relates to the commercial construction of roofs.

BACKGROUND OF THE INVENTION

Exterior openings on the roofs of residential homes and multi-story building are used for a variety of purposes including exhausts vents or valves for dryers, bathroom fans and kitchen fans. Exterior openings may also be used as intake vents or valves for attic fans and dryers. Roofs are exposed to the elements and therefore regularly come in contact with precipitation, such as rain and snow, as well as wind and fog. In order to protect the interior of the home or multi-story building, the exterior openings must be covered in such a way so as to allow the intake and exhaust of air while preventing the entry of precipitation and wind.

One approach to this problem is a curved cover 100 for a roof opening 112 in roof 116, shown in FIG. 1. FIG. I is an illustration of a cross sectional view of a conventional cover 100 for an outdoor roof opening 112. The cover 100 comprises a curved, tubular element having a downward facing orifice 102 at first end 104. The cover 100 curves at section 106 and then straightens out at section 108, ending at orifice 130 on the second end 138. Also shown is a planar element 132 surrounding the brim of the orifice 130. It is shown that nails or screws 134, 136 are used to fasten the planar element 132 of the cover 100 onto the roof 116 so as to cover the roof opening 112.

FIG. 1 also shows rain drop 118 following a diagonal trajectory 120 towards the roof surface 116, as is typical when rain is accompanied by wind. The rain drop 118 impacts the roof 116 at point 114 causing the drop 118 to splatter in various directions. It is shown that one splatter element 122 travels into the orifice 102 of cover 100 and contacts the inner surface 110 of the cover 100. The water of splatter element 122 is then pulled downwards by gravity and trickles or slides down the inner surface of cover 100 into the interior of the building. This is detrimental to a structure, as water and humidity can have deleterious effects on building materials such as wood, concrete and drywall.

Also note that there is a direct path with no obstructions from the orifice 102 of cover 100 into the interior of the building. This is a drawback to the design of cover 100 since the exterior of roofs are often also exposed to animals such as birds, rats, mice, pigeons, possums, squirrels and other rodents. Because birds, rodents and other small animals often seek small volumes in which to live, hide, eat or give birth, the inner volume provided by cover 100 can be a welcoming environment for an animal. As a result, it is commonplace to find that small animals have taken habitat or died inside cover 100, thereby clogging up the orifice 112 of the roof and possibly causing bad odors to enter into the building. It can be difficult to remove a diminutive live animal from a small volume such as that provided by cover 100 and even more difficult to remove a dead or decomposing carcass from such as location.

A further drawback to the design of cover 100 involves debris such as leaves, branches, fruits, and seedpods that may travel into the cover 100 via a strong wind. It is not uncommon to find that debris has clogged the opening 112 of the roof 116 and prevented the intake or exhaust of air via the opening 112. It can be problematic to remove debris that has settled within the cover 100 and caused an obstruction.

Therefore, a need exists to-overcome the problems with the prior art as discussed above, and particularly for a more efficient way to protect a roof opening from precipitation, wind, debris and rodents while allowing the entry or exit of air.

SUMMARY OF THE INVENTION

Briefly, according to an embodiment of the present invention, an apparatus for covering an exterior opening in a roof is disclosed. The apparatus includes a hollow conical element defining an inner volume, the conical element having a first opening on a wide end and a second opening on a narrow end. The apparatus further includes a planar element surrounding an outer brim of the first opening, wherein the planar element accepts a fastener for fastening the apparatus to the roof. The apparatus further includes at least one louver covering the second opening and at least one screen located within the inner volume of the conical element, wherein the at least one screen is fastened to an inner surface of the conical element.

In another embodiment of the present invention, an apparatus for covering an exterior opening in a roof is disclosed. The apparatus includes a hollow conical element comprising a corrosion resistant sheet metal, the conical element having a first opening on a wide end and a second opening on a narrow end. The apparatus further includes a planar element surrounding an outer brim of the first opening, wherein the planar element accepts a fastener for fastening the apparatus to the roof. The apparatus further includes at least one louver covering the second opening and at least one screen located within the conical element, wherein the at least one screen is fastened to an inner surface of the conical element and wherein the at least one screen having a concave shape curving away from the first opening.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention provides an apparatus for adequately covering and protecting an exterior opening in a roof. The louvers of the apparatus of the present invention provide a means for preventing precipitation from entering the interior of a structure via an exterior opening. The apparatus of the present invention further prevents the entrance of debris and small animals via the exterior opening by means of a screen that allows the flow of air but prevents the entry of objects. The apparatus of the present invention is further lightweight and weatherproof so as to allow for easy installation on a roof, while exhibiting durability.

Figure 1:
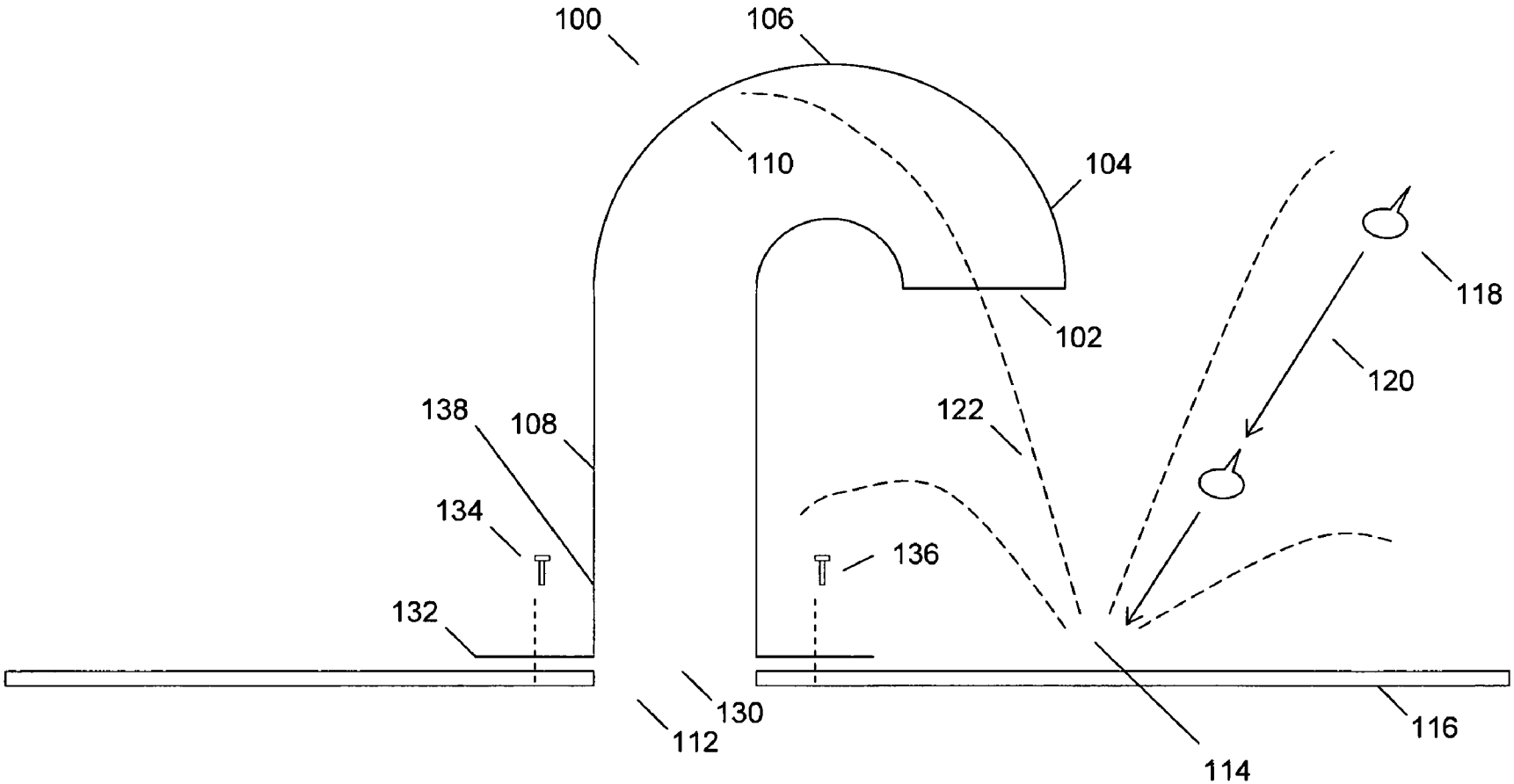
FIG. 1 is an illustration of a cross sectional view of a conventional cover for an outdoor roof opening.
Figure 2:
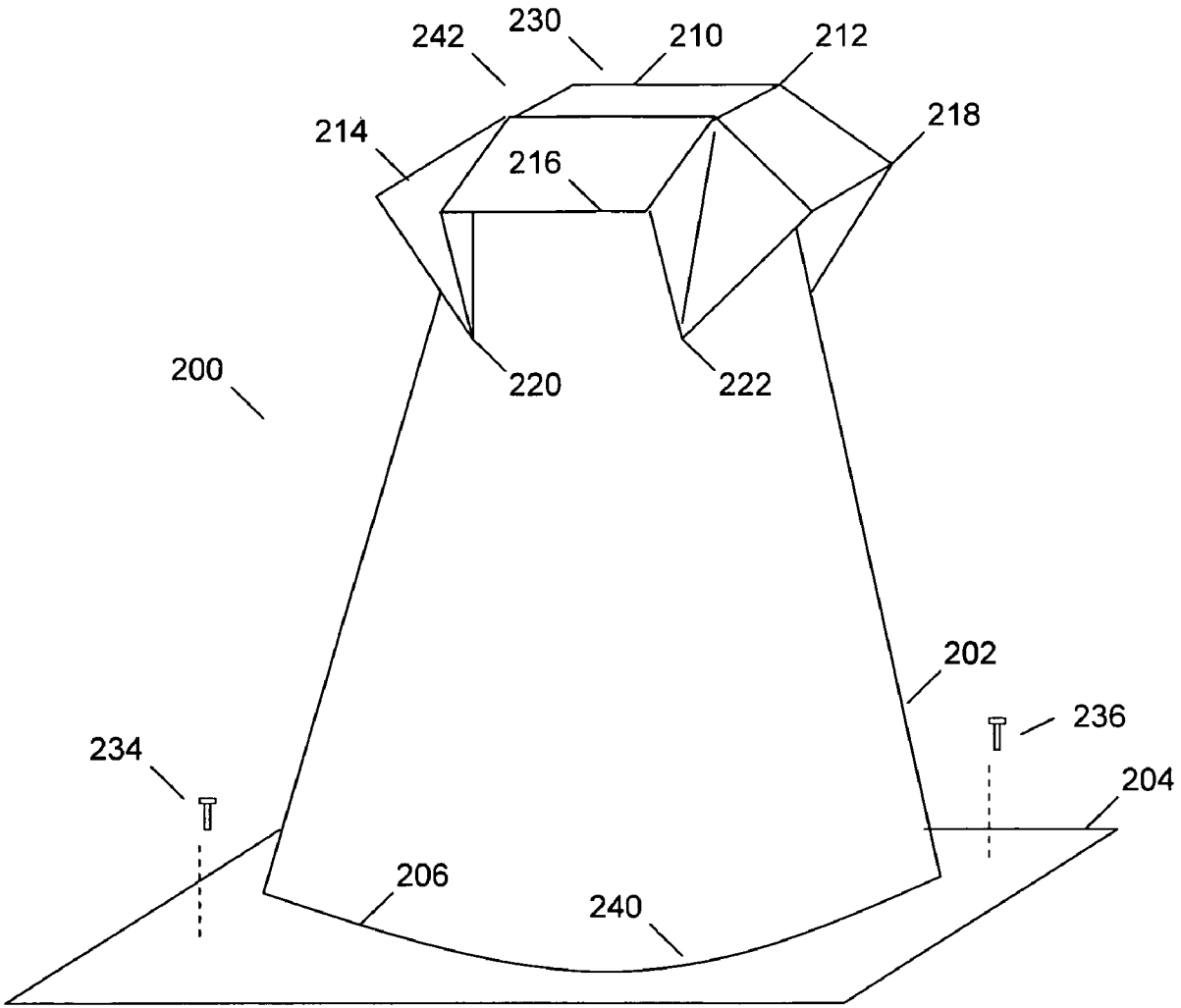
FIG. 2 is an illustration of a perspective view of a cover for an outdoor roof opening, according to one embodiment of the present invention.

FIG. 2 is an illustration of a perspective view of a cover 200 for an outdoor roof opening, according to one embodiment of the present invention. The cover 200 of FIG. 2 includes a hollow conical shaped element 202 defining an inner volume and having a wide first opening along the bottom end 240 and a narrow second opening along the top end 242. The conical element 202 is coupled with a rectangular planar element 204 at juncture 206. The planar element 204 includes an orifice (not shown) that is aligned with the wide first opening of the conical element 202 along the bottom end 240.

The cover 200 of FIG. 2 further includes shield 230 that rests above the second opening of the conical element 202 along the top end 242. The shield 230 comprises a rectangular or square-shaped element 210. On each of the four sides of the square-shaped element 210 a louver protrudes outwards from the square-shaped element 210. Louver 214 protrudes from a left side of the square-shaped element 210, louver 216 protrudes from a front side of the square-shaped element 210, louver 218 protrudes from a right side of the square-shaped element 210 and a last louver (not shown) protrudes from a back side of square-shaped element 210.

Each louver is coupled to the square-shaped element 210 at a seam or juncture. For example, louver 218 is coupled to the square-shaped element 210 at seam 212. Further, each louver is coupled to the conical element 202 at a seam or juncture. For example, louver 216 is coupled to the conical element 202 at seam 220 (also shared by louver 214) and seam 222 (also shared by louver 218.

In an embodiment of the present invention, the cover 200 is attached to a roof surface around an exterior opening via the use of a fastener, such as a nail, a screw, an adhesive and a clip. In another embodiment, cover 200 is attached to a roof surface via a nail such as a 1 and ¼ inch ring shank nail. FIG. 2 shows a ring shank nails 234, 236 being driven through planar element 204 and contacting a roof surface. In another embodiment of the present invention, the width of element 204 is from about 8 inches to about 15 inches, the width of conical element 202 is from about 8 inches to about 12 inches and the height of conical element 202 is from about 8 inches to about 12 inches.

Figure 3:
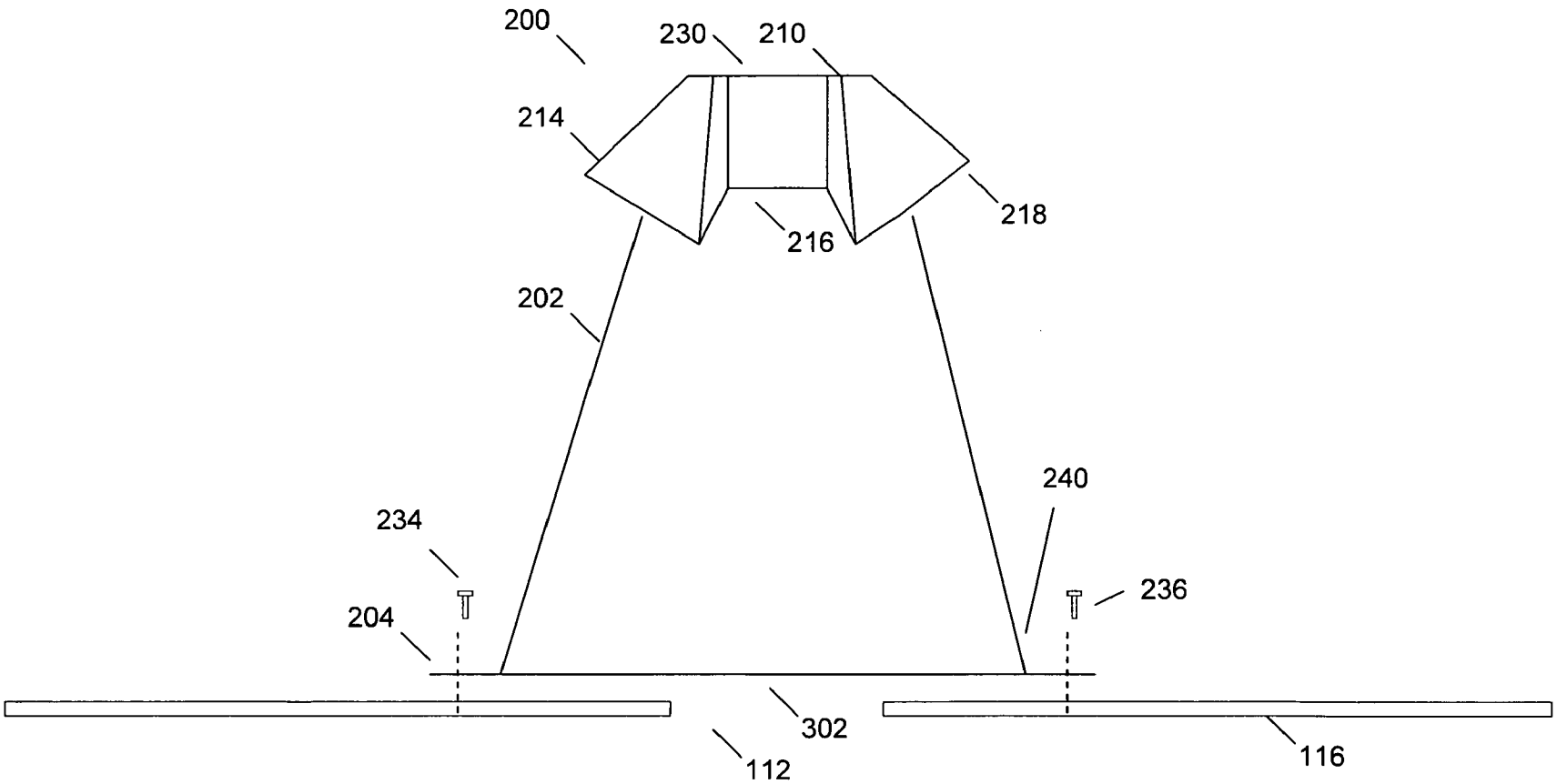
FIG. 3 is an illustration of a frontal view of the cover for an outdoor roof opening shown in FIG. 2.

FIG. 3 is an illustration of a frontal view of the cover 200 for an outdoor roof opening shown in FIG. 2. FIG. 3 shows that the cover 200 protects the roof opening 112 in roof 116. FIG. 3 shows that the planar element 204 surrounds the brim of the orifice 302 along the wide first opening along the bottom end 240 of the conical element 202. It is shown that nails or screws 234, 236 are used to fasten the planar element 204 of the cover 200 onto the roof 116 so as to cover the roof opening 112.

Figure 4:
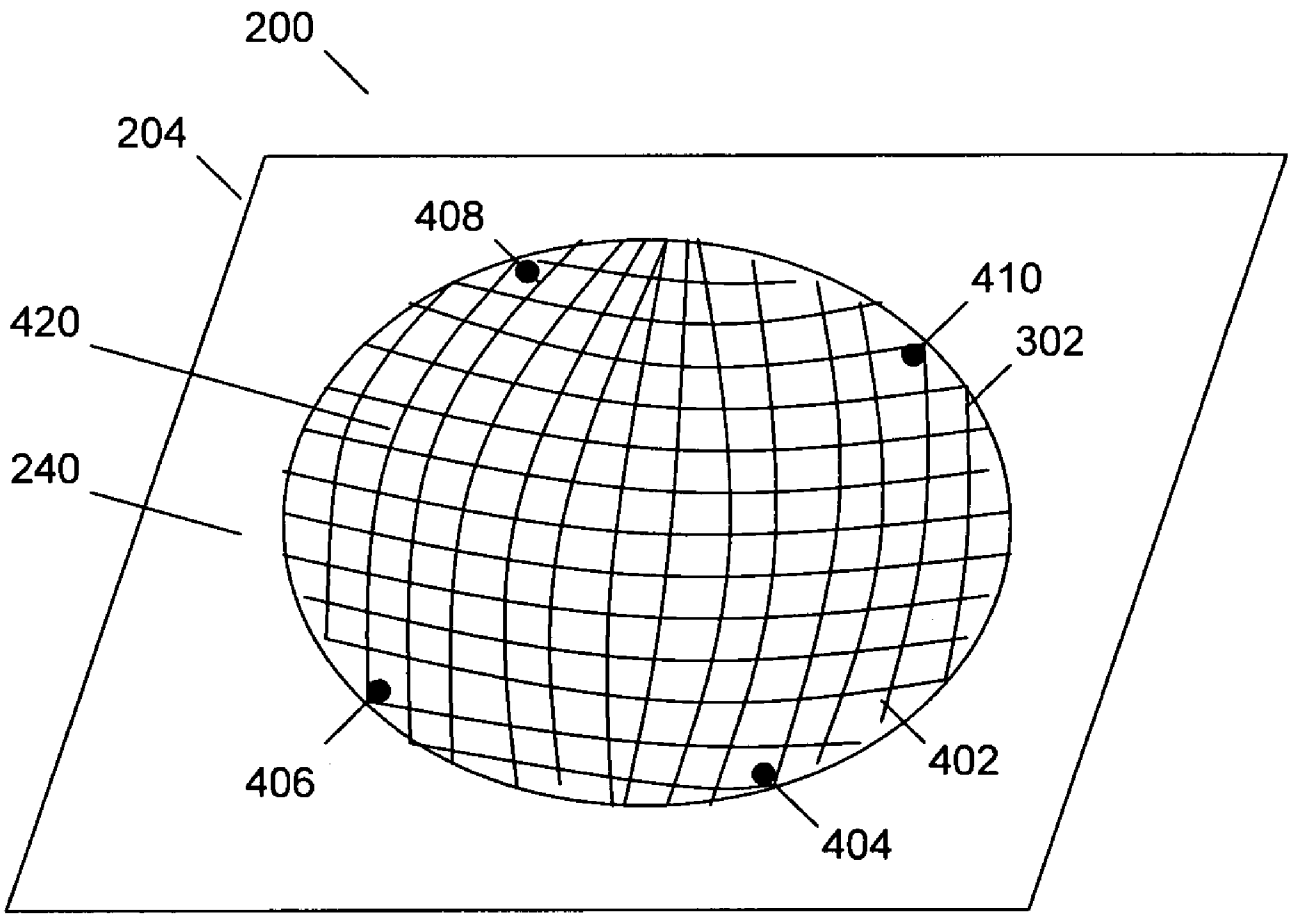
FIG. 4 is an illustration of a bottom perspective view of the cover for an outdoor roof opening shown in FIG. 2.

FIG. 4 is an illustration of a bottom perspective view of the cover 200 for an outdoor roof opening shown in FIG. 2. FIG. 4 shows that the planar element 204 surrounds the brim of the orifice 302 along the wide first opening along the bottom end 240 of the conical element 202. Also shown in orifice 302 is a screen, mesh or lattice grille 402 comprising a first set of close equidistant and parallel lines or bars that intersects with a second set of close equidistant and parallel lines or bars. The screen 402 is attached to an interior surface 420 of the conical element 202 via a plurality of welding nodes 404, 406, 408 and 410 distributed along the interior surface 420 of the conical element 202.

The screen 402 can be manufactured from a variety of materials using a variety of methods. For example, the screen 402 can be manufactured from steel, galvanized steel, metal, plastic, aluminum, galvanized aluminum, sheet metal, plastic and polypropylene.

In one embodiment of the present invention, welding nodes 404, 406, 408 and 410 are produced via gas tungsten arc welding or gas metal arc welding. Gas tungsten arc welding, also known as tungsten inert gas (TIG) welding, is an arc welding process that uses a nonconsumable tungsten electrode to produce the weld. Gas metal arc welding, sometimes referred to by its subtypes, metal inert gas (MIG) welding or metal active gas (MAG) welding, is a semi-automatic or automatic arc welding process in which a continuous and consumable wire electrode and a shielding gas are fed through a welding gun.

In another embodiment of the present invention, the screen 402 includes a concave aspect along its surface wherein the surface curves away from the bottom end 240 of the conical element 202 and towards the top end 242 of the conical element 202. In this manner, the edges of the screen 402 are turned so as to allow for the edges of the surface of the screen 402 to be attached to the interior surface 420 of the conical element 202.

Note that although FIG, 4 shows screen 402 attached to an interior surface 420 of the conical element 202 via a plurality of welding nodes 404, 406, 408 and 410, the present invention supports alternative methods for attaching screen 402 to the interior surface 420 of the conical element 202, such as a mechanical fastener or an adhesive.

Figure 5:
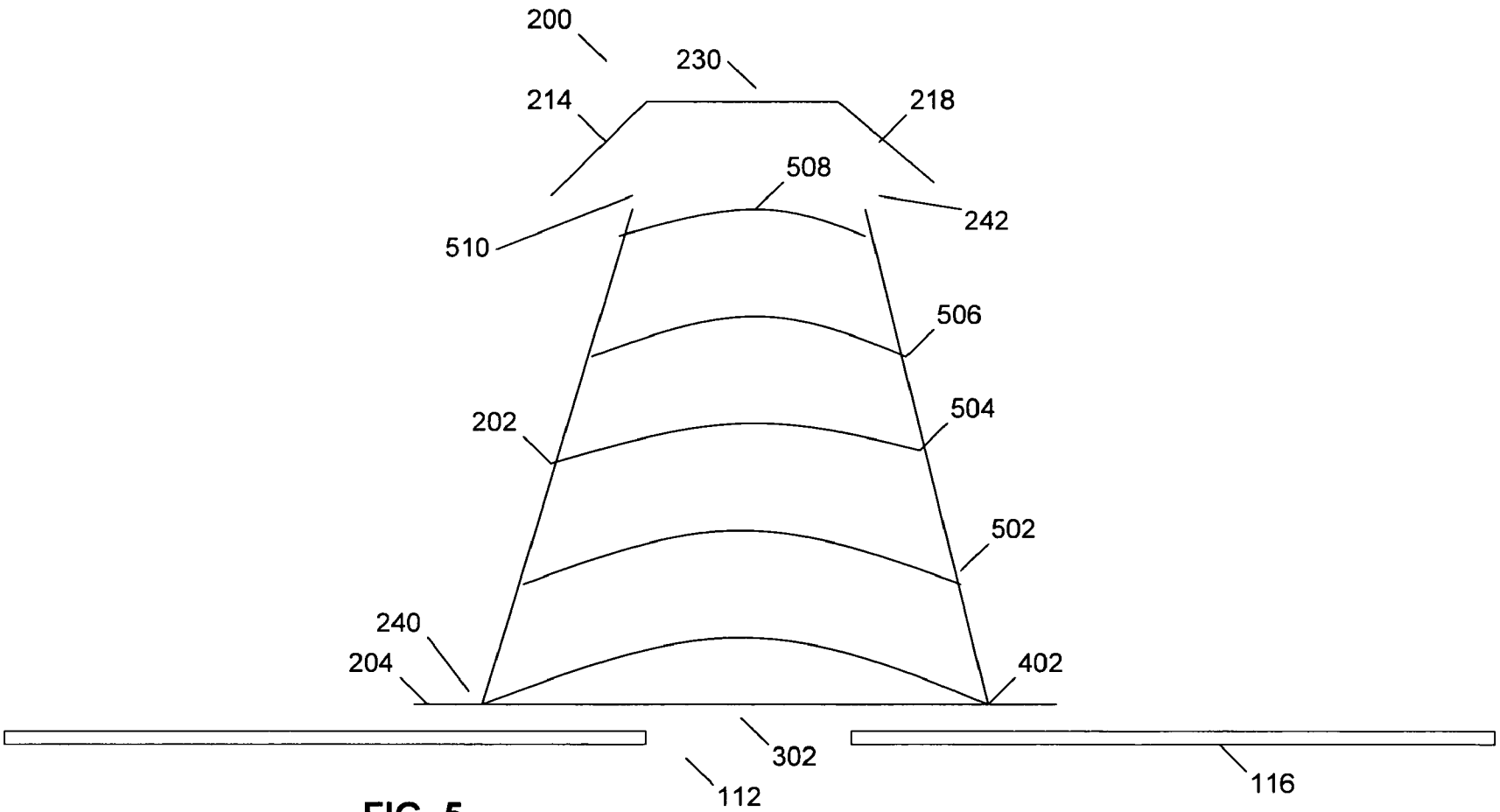
FIG. 5 is an illustration of a cross-sectional view of the cover for an outdoor roof opening shown in FIG. 2.

FIG. 5 is an illustration of a cross-sectional view of the cover 200 for an outdoor roof opening shown in FIG. 2. FIG. 5 shows the possible location of one or more screens 402, 502, 504, 506 and 508 within the interior volume of conical element 202. Screen 402 is located near the brim of the orifice 302 at the bottom end 240 of the conical element 202, while screen 508 is located near the orifice 510 at the top end 242 of the conical element 202. Screens 506, 504 and 502 are positioned in various locations between the bottom end 240 and the top end 242 of conical element 202.

Figure 6:
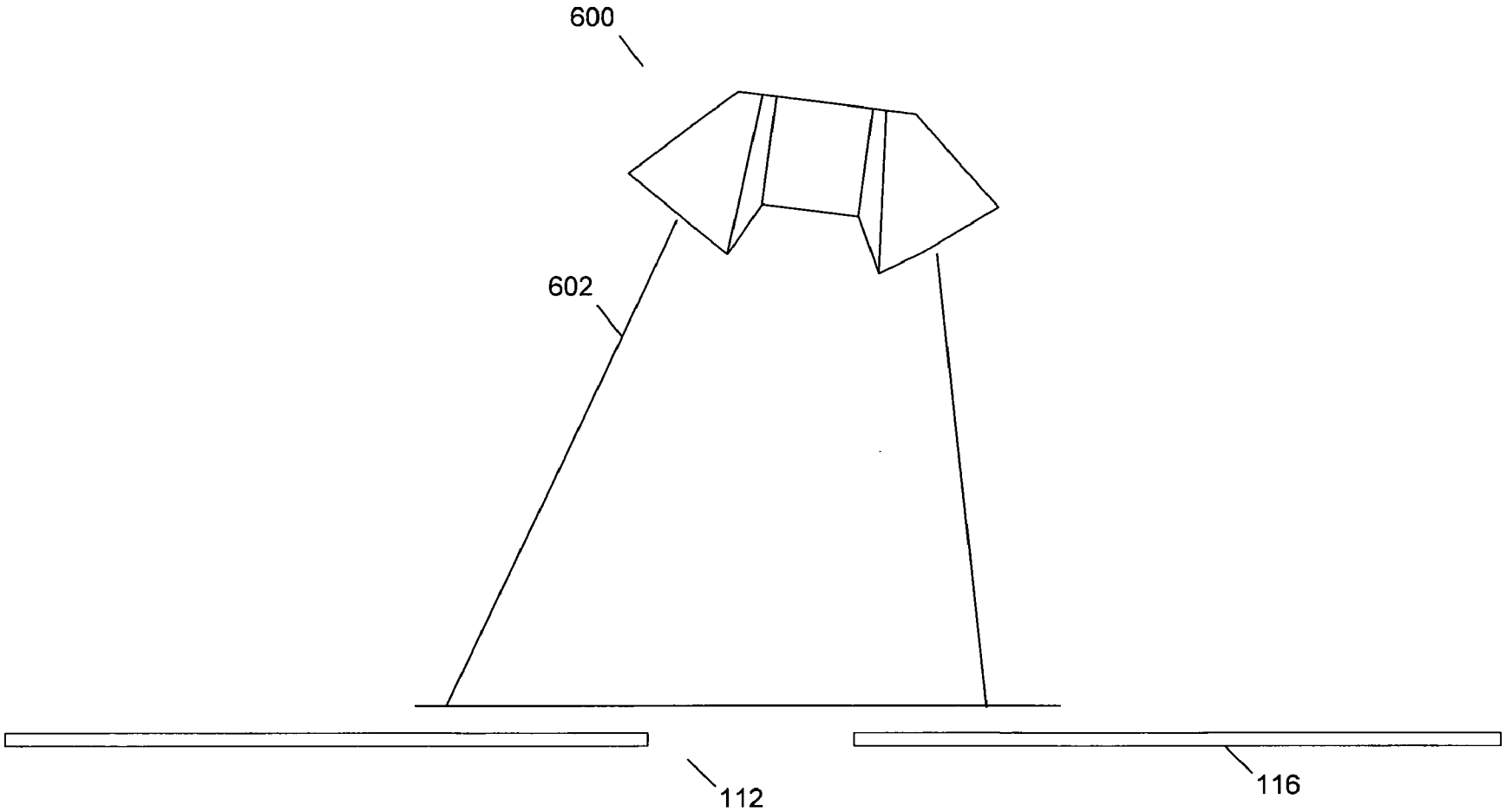
FIG. 6 is an illustration of a frontal view of a cover for an outdoor roof opening, in accordance with another embodiment of the present invention.

FIG. 6 is an illustration of a frontal view of a cover 600 for an outdoor roof opening, in accordance with another embodiment of the present invention. The cover 600 is similar to the cover 200 of FIGS. 2-5, except that the conical element 602 of FIG. 6 is positioned at an angle, such as a thirty-degree angle, from a midline of the apparatus 600. Such an angle allows the apparatus 600 to be placed on a sloping roof having the same angle, thereby positioning the apparatus 600 directly upright.

The apparatus 200 (or apparatus 600) can be manufactured from a variety of materials using a variety of methods. For example, the apparatus 200 can be manufactured from steel, galvanized steel, metal, plastic, aluminum, galvanized aluminum, sheet metal, plastic and polypropylene.

In one embodiment of the present invention, the apparatus 200 can be manufactured from hot-forged alloy steel that is oil quenched and tempered for maximum strength and durability. Alternatively, the apparatus 200 can be manufactured from 26 gauge Type G-90 galvanized metal. Additionally, the apparatus 200 may include nickel-chrome plating that resists rust.

In another embodiment of the present invention, the apparatus 200 (or apparatus 600) can be manufactured from aluminum or an aluminum alloy. Aluminum can be galvanized, non-treated, clear or color anodized. The aluminum alloys are categorized into two types, non-heat-treatable and heat-treatable.

Type 1100 non-heat-treatable aluminum alloys are commercially pure, low-strength alloys having corrosion resistance and satisfactory anodizing and coating finishes. Type 3003 non-heat-treatable aluminum alloys are the most widely used general-purpose alloys because of their corrosion resistance, moderate strength, formability, and weldability. Type 5005 non-heat-treatable aluminum alloys are comparable to Type 3003 in strength and formability, and have good finishing characteristics, making it much better for anodizing. They also exhibit corrosion resistance and weldability, but rates below Type 1100 and Type 3003 alloys for machining.

Type 5052 non-heat-treatable aluminum alloys are versatile high-strength alloys with good forming characteristics and excellent corrosion resistance. Although easily welded, they are not recommended for brazing and soldering applications. Type 2024 heat-treatable aluminum alloys are high-strength alloys with nearly twice the strength of Type 5052, and fair corrosion resistance. Type 6061 heat-treatable aluminum alloys are high-strength alloys that are corrosion resistant and have good finishing, and welding characteristics. Type 7075 heat-treatable aluminum alloys were developed for aircraft applications, and re one of the highest strength, commercially available alloys. They have fair corrosion resistance and machinability.

The apparatus 200 (or apparatus 600) can further be manufactured using a variety of methods for casting metals. Metal casting involves the shaping of free-flowing liquid metals through the use of dies, molds, or patterns. Castings are generally roughly finished due to the nature of their production. In many cases, additional finishing is required to remove burrs and other artifacts of the casting process. Metal castings are used to design a wide range of components and finished products. Common metal casting processes include sand casting, die casting, permanent mold casting, investment casting, centrifugal casting, and lost foam casting.

Die-casting includes a number of processes in which reusable dies or molds are used to produce casting. The die contains an impression of the finished product together with its running, feeding and venting systems. The die is capable of a regular cycle and of (quickly) dissipating the heat of the metal poured into it. Once the liquid metal has cooled sufficiently, the mold is opened and the casting can be removed and finished. In permanent mold casting, molten metal is poured into cast iron molds, coated with a ceramic mold wash. Cores can be metal, sand, sand shell, or other materials. When completed, the molds are opened and the castings are ejected.

Investment casting involves molding patterns by the injection of a special wax into a metal die. The patterns are assembled into a cluster around a wax runner system. The 'tree' of patterns is then coated with eight to ten layers of a refractory material. The assembly is heated to remove the wax. The hot mold is cast, and when cool, the mold material is removed by impact, vibration, grit blasting, high pressure water blasting or chemical dissolution leaving the castings, which are then removed from the runner system.

Centrifugal casting is used to produce castings that are cylindrical in shape. In centrifugal casting, a permanent mold is rotated about its axis at high speeds as the molten metal is poured. The molten metal is centrifugally thrown towards the inside mold wall, where it solidifies. The casting is usually a fine grain casting with a very fine-grained outer diameter, which is resistant to atmospheric corrosion. Lost foam casting is metal casting that uses foam filled patterns to produce castings. Foam is injected into a pattern, filling all areas, leaving no cavities. When molten metal is injected into the pattern, the foam is burned off allowing the casting to take shape.

The apparatus 200 (or apparatus 600) can further be manufactured using metal injection molding (MIM) method for preparing metals. MIM is a powder metallurgy process used for manufacturing metal parts. Although metal injection molding uses powder metal, it is nothing like conventional powder metal processing. The metal powders used in MIM are ten to one hundred times smaller than in powder metal processes. Also, the end product of metal injection molding is much higher in density (greater than 95% theoretical density). Unlike powder metal, products manufactured by MIM can be case or through hardened, painted, and drilled and tapped.

The apparatus 200 (or apparatus 600) can further be manufactured using a variety of metals, such as ferrous metals and alloys. Ferrous metals and alloys are iron-based materials that are used in a wide variety of industrial applications. Examples include carbon steels, alloy steels, stainless steels, tool steels, cast iron, cast steel, maraging steel, and specialty or proprietary iron-based alloys.

There are many types of ferrous metals and alloys. Carbon steels are ferrous alloys that contain carbon and small levels of other alloying elements such as manganese or aluminum. Alloy steels contain low to high levels of elements such as chromium, molybdenum, vanadium and nickel. Stainless steels are highly corrosion resistant, ferrous alloys that contain chromium and/or nickel additions. There are three basic types of products: austenitic stainless steels, ferritic and martensitic stainless steels, and specialty stainless steels and iron super-alloys. Tool steels are wear resistant, but difficult to fabricate in their hardened form. Specific grades are available for cold-working, hot-working, and high speed applications. Cast iron is a ferrous alloy with high amounts of carbon. This category includes ductile iron, gray iron and white cast iron grades. Cast steel alloy grades are made by pouring molten iron into a mold.

The apparatus 200 (or apparatus 600) can further be manufactured using nickel and nickel alloys. Nickel and nickel alloys are non-ferrous metals with high strength and toughness, excellent corrosion resistance, and superior elevated temperature properties. Commercially pure, unalloyed or very low alloy nickel does not contain or contains only very small amounts of alloying elements. By contrast, nickel alloys contain significant amounts of added elements or constituents. Clad or bimetal stock consists of two different alloys that are bonded integrally together. Metal matrix composites have a composite or reinforced metal or alloy matrix filled with a second component, which may be in particulate, chopped fiber, continuous filament, or fabric form. Other unlisted, specialty or proprietary nickel and nickel alloys are also available. These materials are often based on a unique alloy system, use a novel processing technology, or have properties tailored for specific applications.

In one embodiment of the present invention, the apparatus 200 (or apparatus 600) can be manufactured from steel using the hot rolling method. The metallurgical process of hot rolling, used mainly to produce sheet metal or simple cross sections from billets, describes the method of when industrial metal is passed or deformed between a set of work rolls and the temperature of the metal is generally above its recrystallization temperature, as opposed to cold rolling, which takes place below this temperature. This permits large deformations of the metal to be achieved with a low number of rolling cycles.

Because the metal is worked before crystal structures have formed, this process does not itself affect its microstructural properties. Hot rolling is primarily concerned with manipulating material shape and geometry rather than mechanical properties. This is achieved by heating a component or material to its upper critical temperature and then applying controlled load which forms the material to a desired specification or size.

Mechanical properties of the material in its final as-rolled form is a function of: the material chemistry, reheat temperature, rate of temperature decrease during deformation, rate of deformation, heat of deformation, total reduction, recovery time, recrystallisation time, and subsequent rate of cooling after deformation.

In another embodiment of the present invention, the apparatus 200 may be hot-dipped galvanized steel. Hot-dip galvanizing is a form of galvanization. It is the process of coating iron or steel with a thin zinc layer, by passing the steel through a molten bath of zinc at a temperature of around 460° C. When exposed to the atmosphere, pure zinc reacts with oxygen to form zinc oxide, which further reacts with carbon dioxide to form zinc carbonate, a dull gray, fairly strong material that stops further corrosion in many circumstances, protecting the steel below from the elements. Galvanized steel is widely used in applications where rust resistance is needed, and can be identified by the crystalization patterning on the surface (often called a "spangle").

The process of hot-dip galvanizing results in a metallurgical bond between zinc and steel with a series of distinct iron-zinc alloys. The resulting coated steel can be used in much the same way as uncoated. Galvanized steel can be welded; however, one must exercise caution around the resulting zinc fumes. Galvanized steel is suitable for high-temperature applications of up to 200° C. Use at temperatures above this level will result in peeling of the zinc at the intermetallic layer. Galvanized sheet steel is commonly used in automotive manufacture to enhance corrosion performance of exterior body panels of some models.

Steel strip can be hot-dip galvanized in a continuous line. Hot-dip galvanized steel strip (also sometimes loosely referred to as galvanized iron) is extensively used for applications requiring the strength of steel and resistance to corrosion. Applications include: roofing and walling, consumer appliances and automotive body parts. One common use is in metal pails.

Individual metal articles, such as steel girders or wrought iron gates, can be hot-dip galvanized by a process called batch galvanizing. Other modern techniques have largely replaced hot-dip for these sorts of roles. This includes electrogalvanizing, which deposits the layer of zinc from an aqueous electrolyte by electroplating, forming a thinner and much stronger bond.

Zinc coatings prevent corrosion of the protected metal by forming a barrier, and by acting as a sacrificial anode if this barrier is damaged. When exposed to the atmosphere, zinc reacts with oxygen to form zinc oxide, which further reacts with water molecules in the air to form zinc hydroxide. Finally zinc hyroxide reacts with carbon dioxide in the atmosphere to yield a thin, impermiable, tenacious and quite insoluble dull gray layer of zinc carbonate which adheres extremely well to the underlying zinc, so protecting it from further corrosion, in a way similar to the protection afforded to aluminium and stainless steels by their oxide layers.

Hot dip galvanizing deposits a thick, robust layer that may be more than is necessary for the protection of the underlying metal in some applications. This is the case in automobile bodies, where additional rust proofing paint will be applied. Here, a thinner form of galvanizing is applied by electroplating, called "electro-galvanization". However, the protection this process provides is insufficient for products that will be constantly exposed to corrosive materials such as salt water. Nevertheless, most nails made today are electro-galvanized.

Galvanic protection (also known as sacrificial-anode or cathodic protection) can be achieved by connecting zinc both electronically (often by direct bonding to the protected metal) and ionically (by submerging both into the same body of electrolyte, such as a drop of rain). In such a configuration the zinc is absorbed into the electrolyte in preference to the metal that it protects, and maintains that metal's structure by inducing an electric current. In the usual example, ingots of zinc are used to protect a boat's hull and propellers, with the ocean as the common electrolyte.

As noted previously, both mechanisms are often at work in practical applications. For example, the traditional measure of a coating's effectiveness is resistance to a salt spray. Thin coatings cannot remain intact indefinitely when subject to surface abrasion, and the galvanic protection offered by zinc can be sharply contrasted to more noble metals. As an example, a scratched or incomplete coating of chromium actually exacerbates corrosion of the underlying steel, since it is less electrochemically active than the substrate.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. An assembly for covering an exterior opening in a roof, comprising:

a hollow conical element defining an inner volume, the conical element having a first opening on a wide end and a second opening on a narrow end;

a planar element surrounding an outer brim of the first opening, wherein the planar element is substantially perpendicular to the hollow conical element;

a ring shank nail for fastening the planar element to the roof;

at least one louver covering the second opening; and at least one screen located within the inner volume of the conical element, wherein the at least one screen is fastened to an inner surface of the conical element and wherein the at least one screen having a concave shape curving away from the first opening.

2. The assembly of claim 1, wherein the apparatus comprises any one of: steel, galvanized steel, metal, plastic, aluminum, galvanized aluminum, sheet metal, plastic and polypropylene.

3. The assembly of claim 1, wherein the at least one screen is fastened to an inner surface of the conical element with a plurality of welding joints.

4. The assembly of claim 1, wherein the conical element is from about 8 inches to about 12 inches in height.

5. The assembly of claim 4, wherein the first opening of the conical element is from about 8 inches to about 12 inches in diameter.

6. The assembly of claim 1, wherein the planar element comprises an outer perimeter having a square shape.

7. The assembly of claim 6, wherein the planar element is from about 8 inches to about 15 inches in width.

8. The assembly of claim 1, wherein the at least one louver comprises four louvers evenly distributed around a circumference of the second opening.

9. The assembly of claim 8, wherein the at least one louver comprises a square-shaped planar element located above the second opening so as to prevent entrance of objects into the second opening from above.

10. The assembly of claim 1, wherein the at least one screen comprises a corrosion resistant mesh fastened to an inner surface of the conical element adjacent to an inner brim of the first opening.

11. The assembly of claim 10, wherein the at least one screen comprises a concave mesh curving away from the first opening and being fastened to the inner surface of the conical element with a plurality of welding joints.

12. The assembly of claim 11, wherein the at least one screen comprises a corrosion resistant, concave mesh fastened to an inner surface of the conical element located about midway between the first opening and the second opening.

13. An assembly for covering an exterior opening in a roof, comprising:

a hollow conical element comprising a corrosion resistant sheet metal, the conical element having a first opening on a wide end and a second opening on a narrow end;

a planar element surrounding an outer brim of the first opening, wherein the planar element is substantially perpendicular to the hollow conical element;

a rink shank nail for fastening the planar element to the roof;

at least one louver covering the second opening; and at least one screen located within the conical element, wherein the at least one screen is fastened to an inner surface of the conical element and wherein the at least one screen having a concave shape curving away from the first opening.

14. The assembly of claim 13, wherein the apparatus comprises any one of: steel, galvanized steel, metal, plastic, aluminum, galvanized aluminum, sheet metal, plastic and polypropylene.

15. The assembly of claim 13, wherein the at least one louver comprises four louvers evenly distributed around a circumference of the second opening.

16. The assembly of claim 15, wherein the at least one louver comprises a square-shaped planar element located above the second opening so as to prevent entrance of objects into the second opening from above.

17. The assembly of claim 13, wherein the at least one screen comprises a corrosion resistant mesh fastened to an inner surface of the conical element adjacent to an inner brim of the first opening.

18. The assembly of claim 17, wherein the at least one screen comprises a corrosion resistant, concave mesh fastened to an inner surface of the conical element about midway between the first opening and the second opening.

* * * * *